US006451197B1

(12) United States Patent
Kalnes

(10) Patent No.: US 6,451,197 B1
(45) Date of Patent: Sep. 17, 2002

(54) PROCESS FOR HYDROCRACKING A HYDROCARBONACEOUS FEEDSTOCK

(75) Inventor: Tom N. Kalnes, La Grange, IL (US)

(73) Assignee: UOP LLC, Des Plaines, IL (US)

( * ) Notice: Subject to any disclaimer, the term of this patent is extended or adjusted under 35 U.S.C. 154(b) by 18 days.

(21) Appl. No.: 09/781,215

(22) Filed: Feb. 13, 2001

(51) Int. Cl.[7] ..... C01G 69/00; C01G 47/00

(52) U.S. Cl. ..... 208/58; 208/60; 208/100; 208/103; 208/108

(58) Field of Search ..... 208/58, 60, 100, 208/108, 103

(56) References Cited

U.S. PATENT DOCUMENTS 3,328,290 A 6/1967 Hengstebeck ..... 208/89
5,114,562 A 5/1992 Haun et al. ..... 208/89
5,720,872 A 2/1998 Gupta ..... 208/57
5,980,729 A 11/1999 Kalnes et al. ..... 208/89

FOREIGN PATENT DOCUMENTS

WO WO 97/38066 10/1997 ..... C01G/65/12

*Primary Examiner*—Thuan D. Dang
(74) *Attorney, Agent, or Firm*—John G. Tolomei; James C. Paschall; John G. Curtis, Jr.

(57) ABSTRACT

A catalytic hydrocracking process wherein a hydrocarbonaceous feedstock and a liquid recycle stream having a temperature greater than about 500° F. and saturated with hydrogen is contacted with hydrogen and a metal promoted hydrocracking catalyst in a hydrocracking reaction zone at elevated temperature and pressure to obtain conversion to lower boiling hydrocarbons.

11 Claims, 1 Drawing Sheet

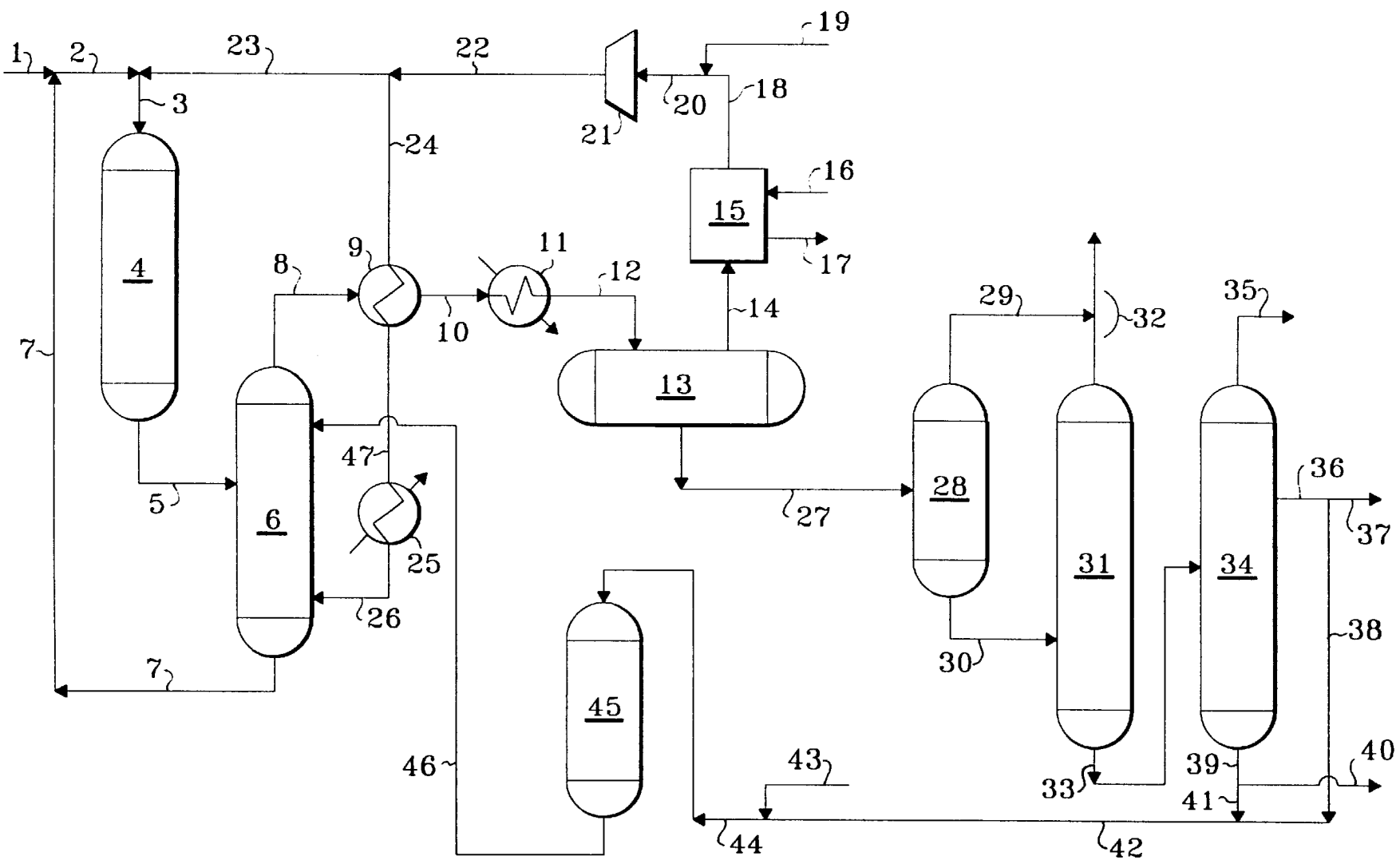
1
2
3
4
5
6
7
7
8
9
10
11
12
13
14
15
16
17
18
19
20
21
22
23
24
25
26
27
28
29
30
31
32
33
34
35
36
37
38
39
40
41
42
43
44
45
46
47

PROCESS FOR HYDROCRACKING A HYDROCARBONACEOUS FEEDSTOCK

BACKGROUND OF THE INVENTION

The field of art to which this invention pertains is the hydrocracking of a hydrocarbonaceous feedstock. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical gas oil comprises a substantial portion of hydrocarbon components boiling above about 700° F., usually at least about 50 percent by weight boiling above 700° F. A typical vacuum gas oil normally has a boiling point range between about 600° F. and about 1050° F.

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

Although a wide variety of process flow schemes, operating conditions and catalysts have been used in commercial activities, there is always a demand for new hydrocracking methods which provide lower costs and higher liquid product yields while maintaining product quality. It is generally known that enhanced product selectivity can be achieved at lower conversion per pass through the catalytic hydrocracking zone. Low conversion per pass is generally more expensive, however, the present invention greatly improves the economic benefits of a low conversion per pass process while preserving product quality.

INFORMATION DISCLOSURE

U.S. Pat. No. 5,720,872 (Gupta) discloses a process for hydroprocessing liquid feedstocks in two or more hydroprocessing stages which are in separate reaction vessels and wherein each reaction stage contains a bed of hydroprocessing catalyst. The liquid product from the first reaction stage is sent to a low pressure stripping stage and stripped of hydrogen sulfide, ammonia and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. The flow of treat gas is in a direction opposite the direction in which the reaction stages are staged for the flow of liquid. Each stripping stage is a separate stage, but all stages are contained in the same stripper vessel.

International Publication No. WO 97/38066 (PCT/US 97/04270) discloses a process for reverse staging in hydroprocessing reactor systems.

U.S. Pat. No. 3,328,290 (Hengstebeck) discloses a two-stage process for the hydrocracking of hydrocarbons in which the feed is pretreated in the first stage.

U.S. Pat. No. 5,114,562 (Haun et al) discloses a process wherein distillable petroleum streams are hydrotreated to produce a low sulfur and low aromatic product utilizing two reaction zones in series. The effluent of the first reaction zone is purged of hydrogen sulfide by hydrogen stripping and then reheated by indirect heat exchange. The second reaction zone employs a sulfur-sensitive noble metal hydrogenation catalyst.

U.S. Pat. No. 5,980,729 (Kalnes et al) discloses a hydrocracking process which utilizes a hot, high-pressure stripper.

BRIEF SUMMARY OF THE INVENTION

The present invention is a catalytic hydrocracking process which provides lower costs and higher liquid product yields while reducing the production of undesirable normally gaseous hydrocarbons and maintaining product quality. The process of the present invention provides the yield advantages associated with a low conversion per pass operation without compromising unit economics. The envisioned high recycle liquid rate will reduce or eliminate the need for hydrogen quench and minimize the fresh feed pre-heat since the hot recycle liquid will provide heat. In addition, the low conversion per pass operation requires less catalyst volume.

In accordance with one embodiment of the present invention, a hydrocarbonaceous feedstock and a liquid recycle stream having a temperature greater than about 500° F. and saturated with hydrogen, and a hydrogen-rich gas is contacted with a metal promoted hydrocracking catalyst in a hydrocracking reaction zone at elevated temperature and pressure sufficient to obtain a substantial conversion of the hydrocarbonaceous feedstock to lower boiling hydrocarbons. The resulting hot, uncooled effluent from the hydrocracking reaction zone is hydrogen stripped in a stripping zone maintained at essentially the same pressure as the hydrocracking zone with a first hydrogen-rich gaseous stream to produce a first gaseous hydrocarbonaceous stream and a first liquid hydrocarbonaceous stream. At least a portion of the first gaseous hydrocarbonaceous stream is condensed to produce a second liquid hydrocarbonaceous stream and a second hydrogen-rich gaseous stream. At least a portion of the first liquid hydrocarbonaceous stream is recycled to supply the liquid recycle stream and at least a portion of the second hydrogen-rich gaseous stream is recycled to provide at least a portion of the hydrogen supplied to the hydrocracking reaction zone. At least a portion of the second liquid hydrocarbonaceous stream is recovered and separated to produce desired hydrocarbonaceous product streams. At least another portion of the second liquid hydrocarbonaceous stream is introduced into a hydrogenation zone and the resulting effluent is introduced into the stripping zone.

In accordance with one embodiment the present invention relates to a process for hydrocracking a hydrocarbonaceous feedstock to produce lower boiling hydrocarbonaceous compounds which process comprises: (a) contacting the hydrocarbonaceous feedstock, a liquid recycle stream having a temperature greater than about 500° F. and saturated with hydrogen, and added hydrogen with a metal promoted hydrocracking catalyst in a hydrocracking zone at elevated temperature and pressure sufficient to obtain a substantial conversion to lower boiling hydrocarbons; (b) stripping the uncooled hydrocarbon effluent from the hydrocracking zone in a hot stripping zone maintained at essentially the same pressure as the hydrocracking zone with a first hydrogen-rich gaseous stream to produce a first gaseous hydrocarbonaceous stream and a first liquid hydrocarbonaceous stream; (c) condensing at least a portion of the first gaseous hydrocarbonaceous stream and separating the same into a second liquid hydrocarbonaceous stream and a second hydrogen-rich gaseous stream; (d) recycling at least a portion of the first liquid hydrocarbonaceous stream to supply at least a portion of the liquid recycle stream in step (a); (e) recycling at least a portion of the second hydrogen-rich gaseous stream from step (c) to supply at least a portion of the added hydrogen in step (a) and at least a portion of the first hydrogen-rich gaseous stream in step (b); (f) introducing at least a portion of the second liquid hydrocarbonaceous stream and hydrogen into a hydrogenation zone; (g) directly introducing the effluent from the hydrogenation zone into the stripping zone as reflux; and (h) recovering at least another portion of the second liquid hydrocarbonaceous stream.

Other embodiments of the present invention encompass further details such as types and descriptions of feedstocks, hydrocracking catalysts, hydrogenation catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that higher liquid product yields and a lower cost of production can be achieved and enjoyed in the above-described hydrocracking process unit. In addition, the quality of the hydrocarbonaceous product stream can be improved for the ever-demanding market.

The process of the present invention is particularly useful for hydrocracking a hydrocarbon oil containing hydrocarbons and/or other organic materials to produce a product containing hydrocarbons and/or other organic materials of lower average boiling point and lower average molecular weight. The hydrocarbon feedstocks that may be subjected to hydrocracking by the method of the invention include all mineral oils and synthetic oils (e.g., shale oil, tar sand products, etc.) and fractions thereof. Illustrative hydrocarbon feedstocks include those containing components boiling above 550° F., such as atmospheric gas oils, vacuum gas oils, deasphalted, vacuum, and atmospheric residua, hydrotreated residual oils, coker distillates, straight run distillates, pyrolysis-derived oils, high boiling synthetic oils, cycle oils and cat cracker distillates. A preferred hydrocracking feedstock is a gas oil or other hydrocarbon fraction having at least 50% by weight, and most usually at least 75% by weight, of its components boiling at temperatures above the end point of the desired product, which end point, in the case of heavy gasoline, is generally in the range from about 380° F. to about 420° F. or in the case of diesel oil in the range from about 660° F. to about 730° F. One of the most preferred gas oil feedstocks will contain hydrocarbon components which boil above 550° F. with best results being achieved with feeds containing at least 25 percent by volume of the components boiling between 600° F. and 1000° F.

Also included are petroleum distillates wherein at least 90 percent of the components boil in the range from about 300° F. to about 800° F. The petroleum distillates may be treated to produce both light gasoline fractions (boiling range, for example, from about 50° F. to about 185° F.) and heavy gasoline fractions (boiling range, for example, from about 185° F. to about 400° F.).

The selected feedstock is introduced into a hydrocracking zone. The hydrocracking zone may contain one or more beds of the same or different catalyst. In one embodiment, when the preferred products are middle distillates the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group III metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. (371°–648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group III metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking conditions which include a temperature from about 450° F. (232° C.) to about 875° F. (468° C.), a pressure from about 500 psig (3448 kPa gauge) to about 3000 psig (20685 kPa gauge), a liquid hourly space velocity (LHSV) from about 0.1 to about 30 $hr^{-1}$ , and a hydrogen circulation rate from about 2000 (337 normal $m^3/m^3$) to about 25,000 (4200 normal $m^3/m^3$) standard cubic feet per barrel (SCFB). In accordance with the present invention, the term "substantial conversion to lower boiling products" is meant to connote the conversion of at least 10 volume percent of the fresh feedstock.

In one embodiment, after the hydrocarbonaceous feedstock has been subjected to hydrocracking as hereinabove described, the resulting uncooled effluent from the hydrocracking reaction zone is introduced into a high pressure stripping zone maintained at essentially the same pressure as the hydrocracking zone and contacted with a first hydrogen-rich gaseous stream to produce a first gaseous hydrocarbonaceous stream containing hydrocarbonaceous compounds boiling at a temperature less than about 700° F. and a first liquid hydrocarbonaceous stream containing hydrocarbonaceous compounds boiling at a temperature greater than about 700° F. The high pressure stripping zone is preferably maintained at a temperature in the range from about 450° F. to about 875° F. The effluent from the hydrocracking reaction zone is not substantially cooled and would only be lower in temperature due to unavoidable heat loss during transport from the reaction zone to the high pressure stripping zone. It is preferred that the cooling of the hydrocracking reaction zone effluent is less than about 50° F. By maintaining the pressure of the high pressure stripping zone at essentially the same pressure as the reaction zone is meant that any difference in pressure is due to the pressure drop required to flow the effluent stream from the reaction zone to the high pressure stripping zone. It is preferred that the pressure drop is less than about 50 psig. The hydrogen-rich gaseous stream is preferably supplied in an amount greater than about 5 weight percent of the hydrocarbonaceous feedstock. A hereinafter-described hydrocarbonaceous stream is introduced into an upper portion of the high pressure stripping zone in an amount of greater than about 5 weight percent of the hydrocarbonaceous feedstock as reflux. The resulting first liquid hydrocarbonaceous stream produced in the high pressure stripping zone is preferably recycled to the catalytic hydrocracking reaction zone in an amount of about 30% to about 300% of the fresh feedstock.

The resulting first gaseous hydrocarbonaceous stream containing hydrocarbonaceous compounds characterized by a normal boiling point temperature less than about 700° F. is preferably cooled to a temperature in the range from about 40° F. to about 360° F. to produce a second liquid hydrocarbonaceous stream which is recovered and subsequently fractionated to produce desired hydrocarbon product streams, and to produce a second hydrogen-rich gaseous stream which is bifurcated to provide at least a portion of the added hydrogen introduced into the hydrocracking zone and at least a portion of the first hydrogen-rich gaseous stream introduced into the high pressure stripping zone. Fresh make-up hydrogen may be introduced into the process at any convenient location and a preferred location is near or at the inlet to the hydrogenation zone. Before the portion of the second hydrogen-rich gaseous stream is introduced into the hydrocracking zone, it is preferred that at least a significant portion, at least about 90 weight percent for example, of the hydrogen sulfide is removed and recovered by means of known, conventional methods.

The second liquid hydrocarbonaceous stream is preferably flashed in a low-pressure flash zone, stripped in a low pressure stripping zone and then fractionated in a fractionation zone to produce a naphtha stream, a kerosene stream and a diesel stream. In accordance with the present invention, at least a portion of the kerosene stream and/or the diesel steam is introduced along with hydrogen into a hydrogenation reaction zone and at least a portion of the resulting effluent is passed into an upper portion of the high pressure stripping zone as described hereinabove.

The hydrogenation reaction zone preferably contains a hydrotreating catalyst and is operated at conditions which include a pressure from about 500 psig (3448 kPa) to about 3000 psig (20685 kPa), a liquid hourly space velocity from 1 to about 30 $hr^{-1}$ and a hydrogen to oil ratio from about 500 to about 5000 standard cubic feet per barrel (SCFB). Any suitable, known hydrotreating catalyst may be utilized in accordance with the present invention.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil and heavy coker gas oil is introduced into the process via line 1 and admixed with a liquid hydrocarbon recycle stream provided via line 7 and the resulting admixture is transported via line 2 and is joined with a hydrogen-rich gaseous stream provided via line 23 and this resulting admixture is introduced via line 3 into hydrocracking zone 4. A hydrocracked hydrocarbon stream having components boiling at a temperature less than about 700° F. (371° C.) is recovered from hydrocracking zone 4 via line 5 and is introduced into high pressure stripping zone 6. A hydrogen-rich gaseous stream is introduced as a stripping gas via line 26 into high pressure stripping zone 6 to produce a gaseous stream effluent containing hydrocarbonaceous compounds boiling at a temperature less than about 700° F. which is removed via line 8 from high pressure stripping zone 6 and is heat exchanged and cooled in heat-exchanger 9, transported via line 10 into heat-exchanger 11 and the resulting cooled effluent is transported via line 12 and introduced into vapor-liquid separator 13. A liquid hydrocarbonaceous stream containing hydrocarbonaceous compounds boiling at a temperature greater than about 700° F. and saturated with hydrogen is removed from high pressure stripping zone 6 via line 7 and is recycled to join the fresh feed stream as described hereinabove. A hydrogen-rich gaseous stream is removed from vapor-liquid separator 13 via line 14 and is introduced into acid gas recovery zone 15. A lean solvent is introduced via line 16 into acid gas recovery zone 15 and contacts the hydrogen-rich gaseous stream in order to dissolve an acid gas. A rich solvent containing acid gas is removed from acid gas recovery zone 15 via line 17 and recovered. A hydrogen-rich gaseous stream containing a reduced concentration of acid gas is removed from acid gas recovery zone 15 via line 18 and is admixed with a hydrogen makeup gaseous stream introduced via line 19. The resulting admixture is carried via line 20 and introduced into compressor 21. A resulting compressed hydrogen-rich gaseous stream is removed from compressor 21 via line 22 and at least a portion is transported via line 23 and admixed with the fresh hydrocarbonaceous feed as described hereinabove. Another portion of the hydrogen-rich gaseous stream is transported via lines 22 and 24 and introduced into heat-exchanger 9 and the resulting heated gas is transported via line 47 and introduced into heat-exchanger 25. The resulting heated gas is removed from heat-exchanger 25 via line 26 and introduced into high pressure stripping zone 6. A liquid hydrocarbonaceous stream is removed from vapor-liquid separator 13 via line 27 and introduced into flash zone 28. A gaseous stream is removed from flash zone 28 via lines 29 and 32 and recovered. A liquid hydrocarbonaceous stream is removed from flash zone 28 via line 30 and introduced into low pressure stripping zone 31. A gaseous stream is removed from low pressure stripping zone 31 via line 32 and recovered. A liquid hydrocarbonaceous stream is removed from low pressure stripping zone 31 via line 33 and introduced into fractionation zone 34. A naphtha hydrocarbon stream is removed from fractionation zone 34 via line 35 and recovered. A kerosene hydrocarbon stream is removed from fractionation zone 34 via line 36 and at least a portion is transported via line 37 and recovered. A diesel hydrocarbon stream is removed from fractionation zone 34 via line 39 and at least a portion is recovered via line 40. At least another portion of the kerosene hydrocarbon stream is transported via line 38 and is admixed with another portion of the diesel hydrocarbon stream carried via line 41 and the resulting admixture is carried via line 42 and is admixed with a hydrogen-rich gaseous stream introduced via line 43 and the resulting admixture is carried via line 44 and introduced into hydrogenation zone 45. The resulting effluent from hydrogenation zone 45 is transported via line 46 and is introduced into high pressure stripping zone 6.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A hydrocracker feedstock in an amount of 100 mass units and having the characteristics presented in Table 1 is hydrocracked in a hydrocracking zone along with a hot liquid recycle stream saturated with hydrogen in an amount of 184 mass units and a hydrogen-rich gaseous stream in an amount of 26 mass units at operating conditions presented in Table 2. The effluent from the hydrocracking reaction zone in an amount of 310 mass units is introduced into a hot high pressure stripper operated at a pressure of 1750 psig and an inlet temperature of about 750° F. The high pressure stripper is stripped with 15 mass units of hot hydrogen. A hot liquid recycle stream in an amount of 184 mass units is removed from the bottom of the hot high pressure stripper and recycled to the hydrocracking zone as described hereinabove. The overhead stream from the hot high pressure stripper is partially condensed to provide the hydrogen-rich gaseous stream to the hydrocracking zone and the hot, high pressure stripper, and a liquid stream which is flashed, stripped and fractionated to produce the net hydrocarbon products as listed in Table 3 and a liquid stream containing kerosene and diesel in an amount of 50 mass units which is introduced into the hydrogenation reaction zone along with 3 mass units of make-up hydrogen. The hydrogenation reaction zone is operated at a pressure of about 1750 psig, an average catalyst temperature of about 460° F. and a hydrogen to oil ratio of about 3000 SCFB.

TABLE 1

Hydrocracker Feedstock Analysis
80/20 Blend Straight Run Vacuum Gas Oil-Coker Gas Oil

| | | |
|---|---|---|
| Gravity, ° API | 21 | |
| Distillation, Volume Percent | | |
| IBP, ° F. (° C.) | 665 | (357) |
| 10 | 715 | (379) |
| 50 | 818 | (436) |
| 90 | 965 | (518) |
| EP | 1050 | (565) |
| % Distilled | 98 | |
| Sulfur, weight percent | 3 | |
| Nitrogen, weight percent | 0.12 | |
| Concarbon, weight percent | 0.3 | |
| Heptane Insolubles, weight percent | 0.02 | |

TABLE 2

Hydrocracking Reaction Zone Operating Conditions

| | |
|---|---|
| Pressure, psig | 1800 |
| Hydrogen to Feed Ratio, SCFB | 11,000 |
| Average Catalyst Temperature, ° F. | 750 |
| Conversion Per Pass, % | 30 |

TABLE 3

Net Hydrocarbon Products

| Stream | Mass Units |
|---|---|
| Fuel Gas | 1 |
| Liquefied Petroleum Gas (LPG) | 2 |

TABLE 3-continued

| Net Hydrocarbon Products | |
|---|---|
| Stream | Mass Units |
| Light Naphtha | 5 |
| Heavy Naphtha | 8 |
| Kerosene | 26 |
| Diesel | 58 |

The foregoing description, drawing and illustrative embodiment clearly illustrate the advantages encompassed by the process of the present invention and the benefits to be afforded with the use thereof.

What is claimed:

1. A process for hydrocracking a hydrocarbonaceous feedstock to produce lower boiling hydrocarbonaceous compounds which process comprises:

(a) contacting the hydrocarbonaceous feedstock, a liquid recycle stream having a temperature greater than about 500° F. and saturated with hydrogen, and added hydrogen with a metal promoted hydrocracking catalyst in a hydrocracking zone at elevated temperature and pressure sufficient to obtain a substantial conversion to lower boiling hydrocarbons without cooling the lower boiling hydrocarbons;

(b) stripping the uncooled lower boiling hydrocarbons from the hydrocracking zone in a hot stripping zone maintained at essentially the same pressure as the hydrocracking zone with a first hydrogen-rich gaseous stream to produce a first gaseous hydrocarbonaceous stream and a first liquid hydrocarbonaceous stream;

(c) condensing at least a portion of the first gaseous hydrocarbonaceous stream and separating the same into a second liquid hydrocarbonaceous stream and a second hydrogen-rich gaseous stream;

(d) recycling at least a portion of the first liquid hydrocarbonaceous stream to supply at least a portion of the liquid recycle stream in step (a);

(e) recycling at least a portion of the second hydrogen-rich gaseous stream from step (c) to supply at least a portion of the added hydrogen in step (a) and at least a portion of the first hydrogen-rich gaseous stream in step (b);

(f) introducing at least a portion of the second liquid hydrocarbonaceous stream and hydrogen into a hydrogenation zone;

(g) directly introducing the effluent from the hydrogenation zone into the stripping zone as reflux; and (h) recovering at least another portion of the second liquid hydrocarbonaceous stream.

2. The process of claim 1 wherein the hydrocracking zone is maintained at a pressure from about 500 psig to about 3000 psig.

3. The process of claim 1 wherein the hydrocracking zone is maintained at a temperature from about 450° F. to about 875° F.

4. The process of claim 1 wherein the metal promoted hydrocracking catalyst comprises synthetic faujasite.

5. The process of claim 1 wherein the metal promoted hydrocracking catalyst comprises a metal selected from the group consisting of Group VIII and Group VIB.

6. The process of claim 1 wherein the hydrocarbonaceous feedstock boils at a temperature greater than about 650° F.

7. The process of claim 1 wherein the liquid recycle stream is present in an amount from about 50 to about 500 volume percent based on the hydrocarbonaceous feedstock.

8. The process of claim 1 wherein the metal promoted hydrocracking catalyst comprises silica-alumina.

9. The process of claim 1 wherein the second hydrogen-rich gaseous stream is recycled to step (b) at a rate of greater than about 5 weight percent of the hydrocarbonaceous feedstock.

10. The process of claim 1 wherein the effluent from the hydrogenation zone to the stripping zone is supplied at a rate of greater than about 10 weight percent of the hydrocarbonaceous feedstock.

11. The process of claim 1 wherein the hydrogenation zone in step (g) contains a catalyst comprising a noble metal.

* * * * *